US008573418B2

(12) United States Patent
Lin

(10) Patent No.: US 8,573,418 B2
(45) Date of Patent: Nov. 5, 2013

(54) RACK ASSEMBLY FOR DISPLAYING CURTAIN

(76) Inventor: Ruei-Hsing Lin, Taipei Hsien (TW)

( * ) Notice: Subject to any disclaimer, the term of this patent is extended or adjusted under 35 U.S.C. 154(b) by 285 days.

(21) Appl. No.: 12/963,643

(22) Filed: Dec. 9, 2010

(65) Prior Publication Data

US 2012/0145656 A1 Jun. 14, 2012

(51) Int. Cl.

| | |
|---|---|
| ***A47F 5/00*** | (2006.01) |
| *G09F 7/00* | (2006.01) |
| *A47H 5/00* | (2006.01) |

(52) U.S. Cl.

USPC ..... 211/180; 40/601; 160/342

(58) Field of Classification Search

USPC ..... 211/180, 183, 16, 113, 118, 175, 209, 211/26, 182, 189, 195; 160/328, 329, 350, 160/342, 84.06; 248/125.2; 40/601, 517

See application file for complete search history.

(56) References Cited

U.S. PATENT DOCUMENTS

| | | | | | |
|---|---|---|---|---|---|
| 844,687 | A * | 2/1907 | Miller | 211/175 |
| 1,227,152 | A * | 5/1917 | Johanson | 52/67 |
| 1,285,311 | A * | 11/1918 | Hohar | 211/119.17 |
| 1,604,937 | A * | 10/1926 | Edsall | 16/87.8 |
| 2,531,925 | A * | 11/1950 | Taylor et al. | 108/147 |
| 3,056,193 | A * | 10/1962 | Johnson et al. | 29/407.05 |
| 5,319,870 | A * | 6/1994 | Weiss | 40/606.14 |
| 5,370,722 | A * | 12/1994 | Simmons | 55/351 |
| 5,421,394 | A * | 6/1995 | Forrest | 160/350 |
| 5,507,109 | A * | 4/1996 | Rinzler | 40/603 |
| 5,555,659 | A * | 9/1996 | Hade | 40/604 |
| 5,657,808 | A * | 8/1997 | Lin | 160/330 |
| 5,934,485 | A * | 8/1999 | Harris et al. | 211/26 |
| 5,975,187 | A * | 11/1999 | Chou | 160/345 |
| 6,439,293 | B1 * | 8/2002 | Kirkpatrick | 160/350 |
| 6,609,621 | B2 * | 8/2003 | Denny et al. | 211/189 |
| 6,739,463 | B2 * | 5/2004 | Wishart et al. | 211/189 |
| 6,976,598 | B2 * | 12/2005 | Engel | 211/187 |
| 7,231,954 | B2 * | 6/2007 | Green | 160/350 |
| 7,730,926 | B2 * | 6/2010 | Moriya et al. | 160/84.06 |
| 7,788,769 | B2 * | 9/2010 | Wicker et al. | 16/87 R |
| 7,942,184 | B2 * | 5/2011 | Cech et al. | 160/84.05 |
| 8,220,521 | B2 * | 7/2012 | Tischer et al. | 160/310 |
| 8,240,740 | B2 * | 8/2012 | Chenowth et al. | 296/100.11 |
| 8,256,062 | B2 * | 9/2012 | Banks et al. | 16/87 R |
| 8,267,360 | B2 * | 9/2012 | Su | 248/123.11 |
| 2004/0149402 | A1 * | 8/2004 | Lin | 160/342 |
| 2004/0182809 | A1 * | 9/2004 | Calleja | 211/180 |
| 2005/0109892 | A1 * | 5/2005 | Bober et al. | 248/125.2 |
| 2005/0263470 | A1 * | 12/2005 | Horneland | 211/183 |
| 2006/0243397 | A1 * | 11/2006 | Liang | 160/84.06 |
| 2007/0187349 | A1 * | 8/2007 | Calleja | 211/189 |
| 2008/0047917 | A1 * | 2/2008 | Hernandez et al. | 211/180 |

(Continued)

*Primary Examiner* — Joshua J Michener
*Assistant Examiner* — Devin Barnett

(57) ABSTRACT

The rack assembly contains a number of vertical rail members and each rail member contains two or more column elements, a number of connection elements, and a number of fastening elements. Each column element has a number of connection grooves and sliding grooves. The connection elements are positioned between and connected to two adjacent column elements. Two vertically adjacent connection elements are locked together by a fastening element. The rack assembly allows a number of stretching members movably configured. Each stretching member contains a number of wheel elements and at least an elastic hook element. The wheel elements are embedded into the sliding grooves of a column element and the stretching members as such could slide along the column element to various positions and, by connecting the elastic hook elements to a curtain's various spots, the curtain is stretched from multiple directions.

7 Claims, 7 Drawing Sheets

(56) References Cited

U.S. PATENT DOCUMENTS

2008/0115894 A1* 5/2008 Cech et al. ..... 160/168.1 V
2009/0075552 A1* 3/2009 Frank et al. ..... 446/82
2012/0144625 A1* 6/2012 Lin ..... 16/87.8
2012/0212894 A1* 8/2012 Henderson ..... 361/679.02

* cited by examiner

RACK ASSEMBLY FOR DISPLAYING CURTAIN

TECHNICAL FIELD OF THE INVENTION

The present invention is generally related to racks for expanding and displaying a curtain, and more particularly to a rack assembly providing speedy, flexible, and easy assembly with enhanced strength and reliability.

DESCRIPTION OF THE PRIOR ART

Advertisement has become a form of communication and, as technology advances, the form of advertisement has taken up many different styles, tangible and intangible.

Despite that, physical means such as billboards and curtains are still widely popular and people encounter these advertisement means constantly at road intersections or exhibition halls. Conventionally, an advertisement curtain is stretched by a number hook sets and the hook sets are mounted in rails of independently raised columns. The hook sets are pulled through the columns by cables and the curtain is thereby raised and expanded. By the stretching of the hook sets, the advertisement curtain is therefore flatly displayed.

The curtain as described is supported by a number of independent columns, each directly inherit the force and impact exerted on the advertisement curtain by winds from various directions. When the winds are strong and the vibration or shaking is stronger than what could be withstood by the columns, the columns could be bended or even broken. In addition, significant cost is involved for replacing or fixing the columns.

Additionally, there is a single rail in each column sustaining the impact of the curtain. Therefore, when the curtain is under the winds from various directions, the hook sets would continue collide with the columns and as such large clanking noise is produced. In the worst case, the rails could be deformed or damaged as such.

Of course it is possible to combine two or more columns into a stronger post. However, usually welding is required for such combination and the assembly cost and effort is inevitably and significantly increased. Also, it would be another costly issue when the advertisement curtain has to be torn down and removed.

SUMMARY OF THE INVENTION

Therefore, a novel rack assembly is provided to obviate the foregoing shortcomings of the prior art which involves independent columns and single rail in each column.

The rack assembly contains a number of vertical rail members and each rail member contains two or more column elements, a number of connection elements, and a number of fastening elements. Each column element has a number of connection grooves and a number of sliding grooves, all axially aligned along the rack element's circumference. Each connection element has a notch at a top end, a through hole is at a bottom end, and two connection blocks at two lateral ends, respectively. The connection elements are stacked vertically, with an upper one's through hole aligned with a lower one's notch. The connection elements are then positioned between and connected to two adjacent column elements with their connection blocks embedded into the connection grooves of the column elements. Two vertically adjacent connection elements are locked together by a fastening element. The rack assembly allows a number of stretching members movably configured. Each stretching member contains a number of wheel elements and at least an elastic hook element. The wheel elements are embedded into the sliding grooves of a column element and the stretching members as such could slide along the column element to various positions and, by connecting the elastic hook elements to a curtain's various spots, the curtain is stretched from multiple directions.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
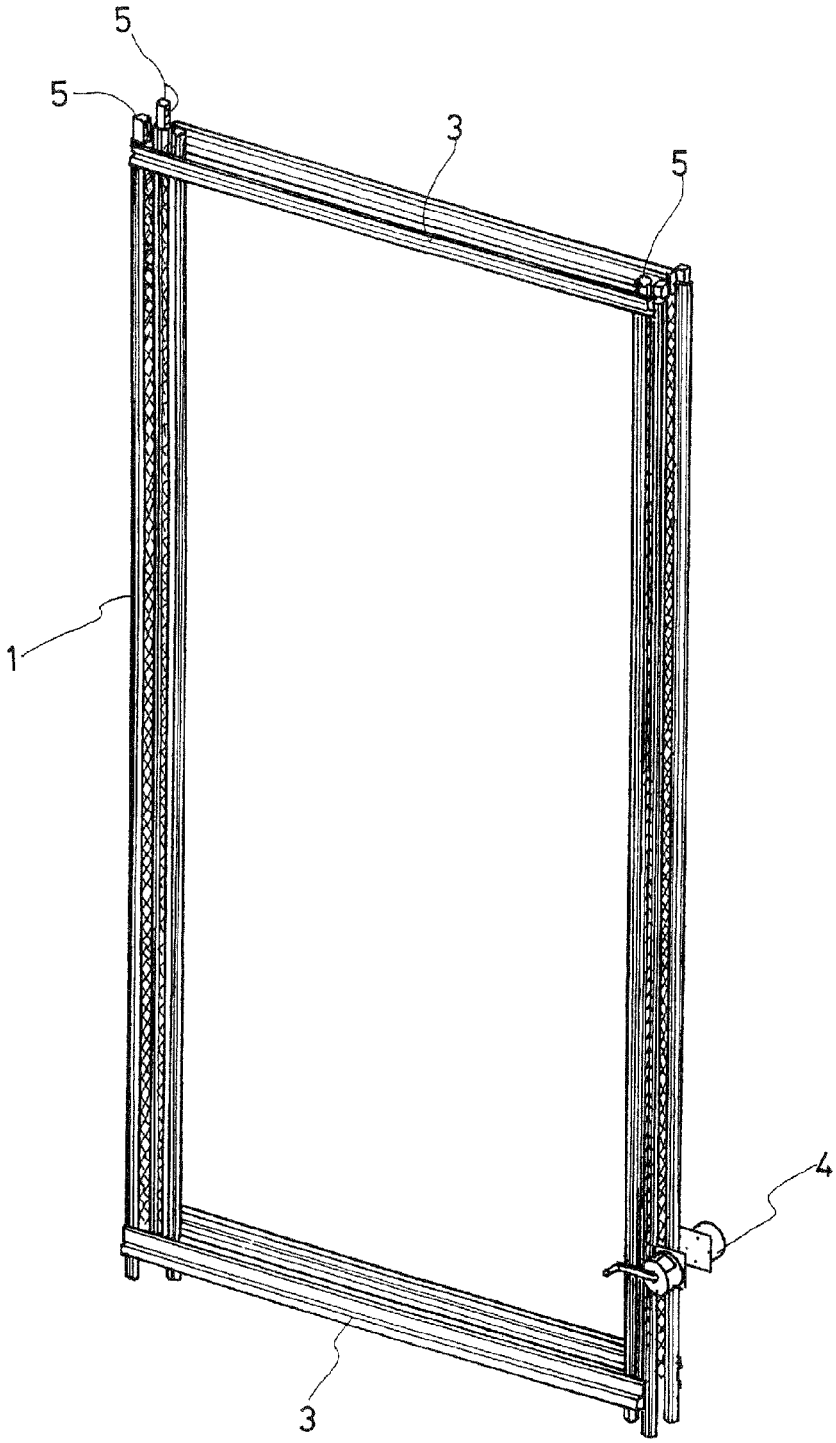
FIG. 1 is a perspective diagram showing a rack assembly according to an embodiment of the present invention after its assembly.
Figure 2:
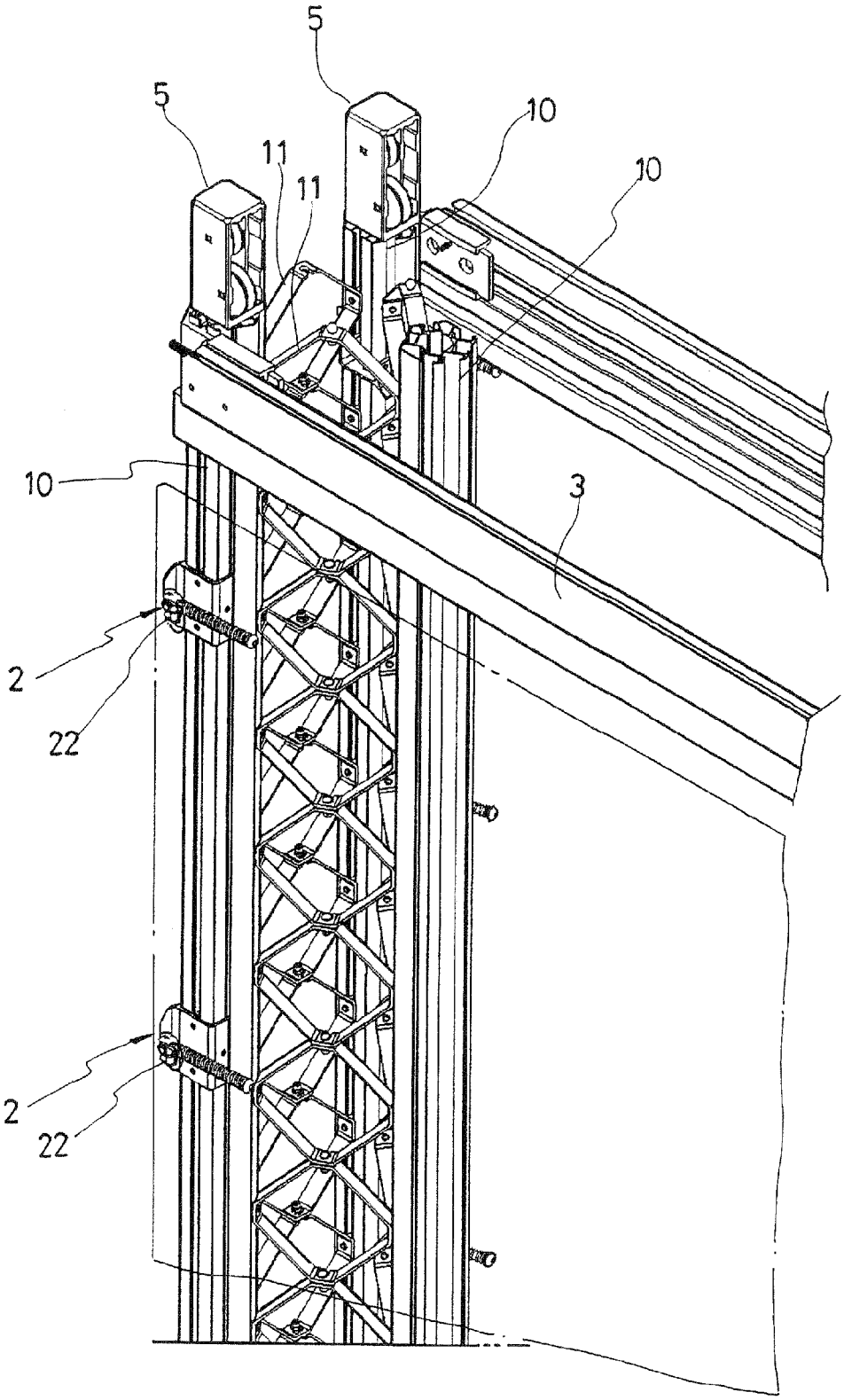
FIG. 2 is a perspective diagram showing a partially enlarged rail member of the rack assembly of FIG. 1.
Figure 3:
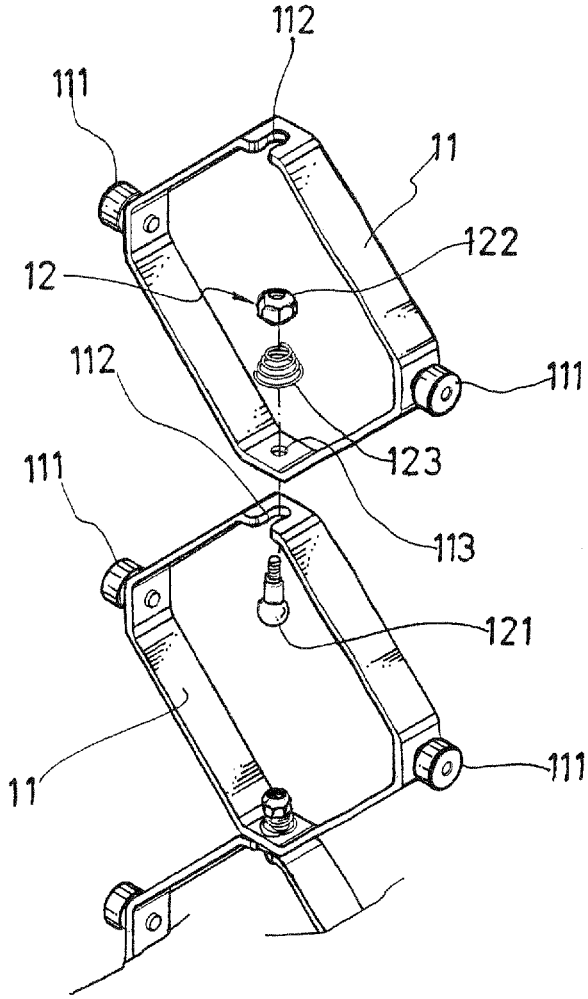
FIG. 3 is a perspective diagram showing the connection of connection elements of the rack assembly of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

A rack assembly for the display of a curtain according to an embodiment of the present invention is shown in FIGS. 1 to 5. The rack assembly contains a number of vertical rail members 1 and each rail member 1 contains two or more column elements 10, a number of connection elements 11, and a number of fastening elements 12. The rack assembly allows a number of stretching members 2 movably configured. Each stretching member 2 contains a number of wheel elements 21 and at least an elastic hook element 22. A curtain 6 is stretched by the elastic hook elements 22 of the stretching members 2.

Figure 5:
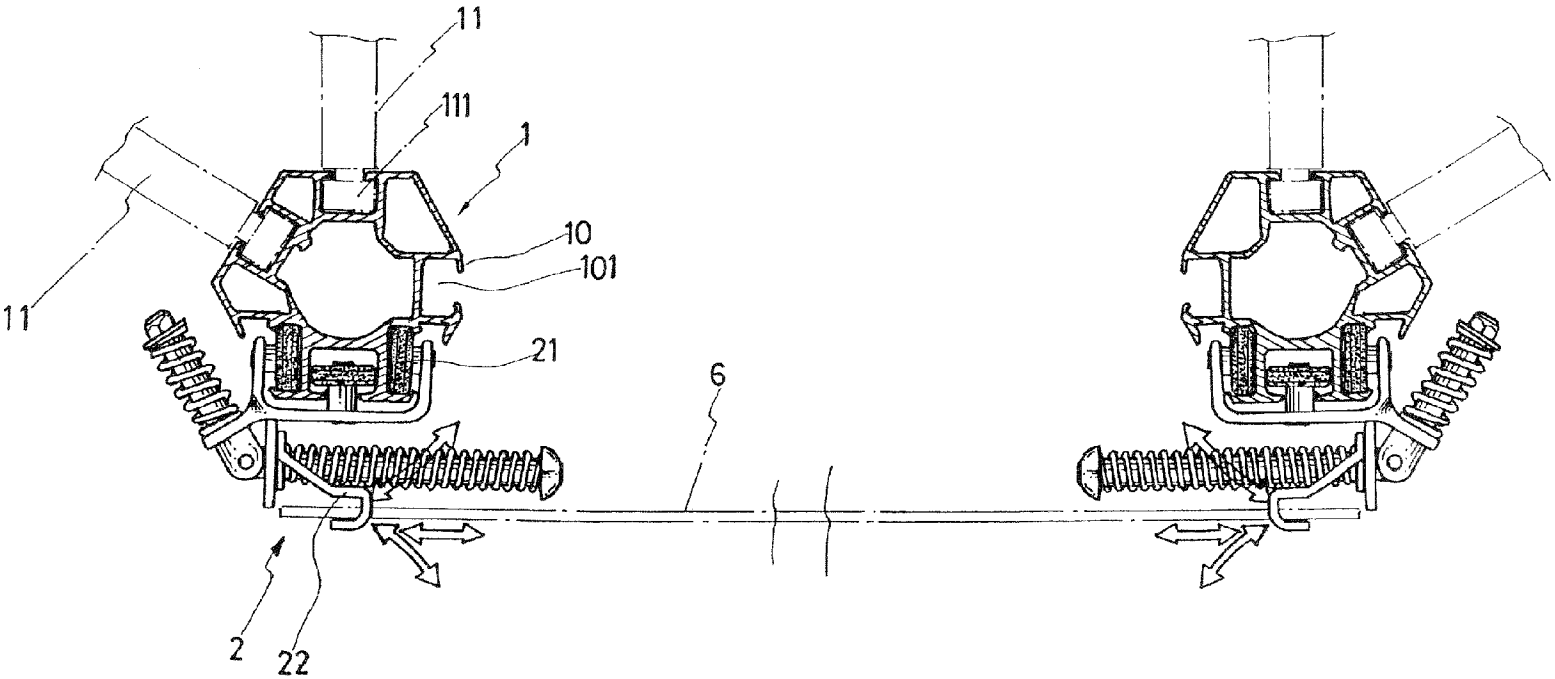
FIG. 5 is a top-view diagram showing the rack assembly of FIG. 1 having two rail members displaying a curtain.

Each column element 10 has a number of connection grooves 101 and a number of sliding grooves 102, all axially aligned along the rack element 10's circumference. The connection groves 101 are adjacent but face different directions. The sliding grooves 102 are also adjacent and allow the embedding of the wheel elements 21 of the stretching members 2, respectively (as shown in FIG. 5).

Each connection element 11 is a closed ring where the ring could be circular, diamond-shaped, rectangular, or polygonal. A notch 112 is at a top end and a through hole 113 is at a bottom end of the connection element 11. Two connection blocks 111 are at two lateral ends of the connection element 11, respectively. The connection elements 11 are stacked vertically, with an upper one's through hole 113 aligned with a lower one's notch 112. The connection elements 11 are then positioned between and connected to two adjacent column elements 10 with their connection blocks 111 embedded into the connection grooves 101 of the column elements 10.

Two vertically adjacent connection elements 11 are locked together by a fastening element 12. Each fastening element 12 contains a bolt 121, a nut 122, and a spring 123. The bolt 121 is threaded first through the spring 123, and then through the through hole 113 and the notch 112 of two vertically adjacent connection elements 11. The bolt 121 is then screwed tightly with the nut 123. The fastening element 12 provides reliably locking with the expansion of the spring 122. In addition, the spring 122 also facilitates the unlocking of the bolt 121 and the nut 123. The notch 112, on the other hand, facilitates the positioning and aiming of the bolt 121 to the through hole 113.

To assembly a rail member 1, in the present embodiment, three column elements 10 are pair-wise connected by connection elements 11 by embedding the connection blocks 111 into two adjacent column elements 10's connection grooves 101, respectively, so as to form a triangular prism of enhanced strength. The vertically stacked connection elements 11 are also pair-wise connected by fastening elements 12. Then, the wheel elements 21 of the stretching members 2 are embedded into the sliding grooves 102 of a column element 10 and the stretching members 2 as such could slide along the column element 10 to various positions and, by connecting the elastic hook elements 22 to the curtain 6's various spots, the curtain 6 is stretched from multiple directions.

Figure 4:
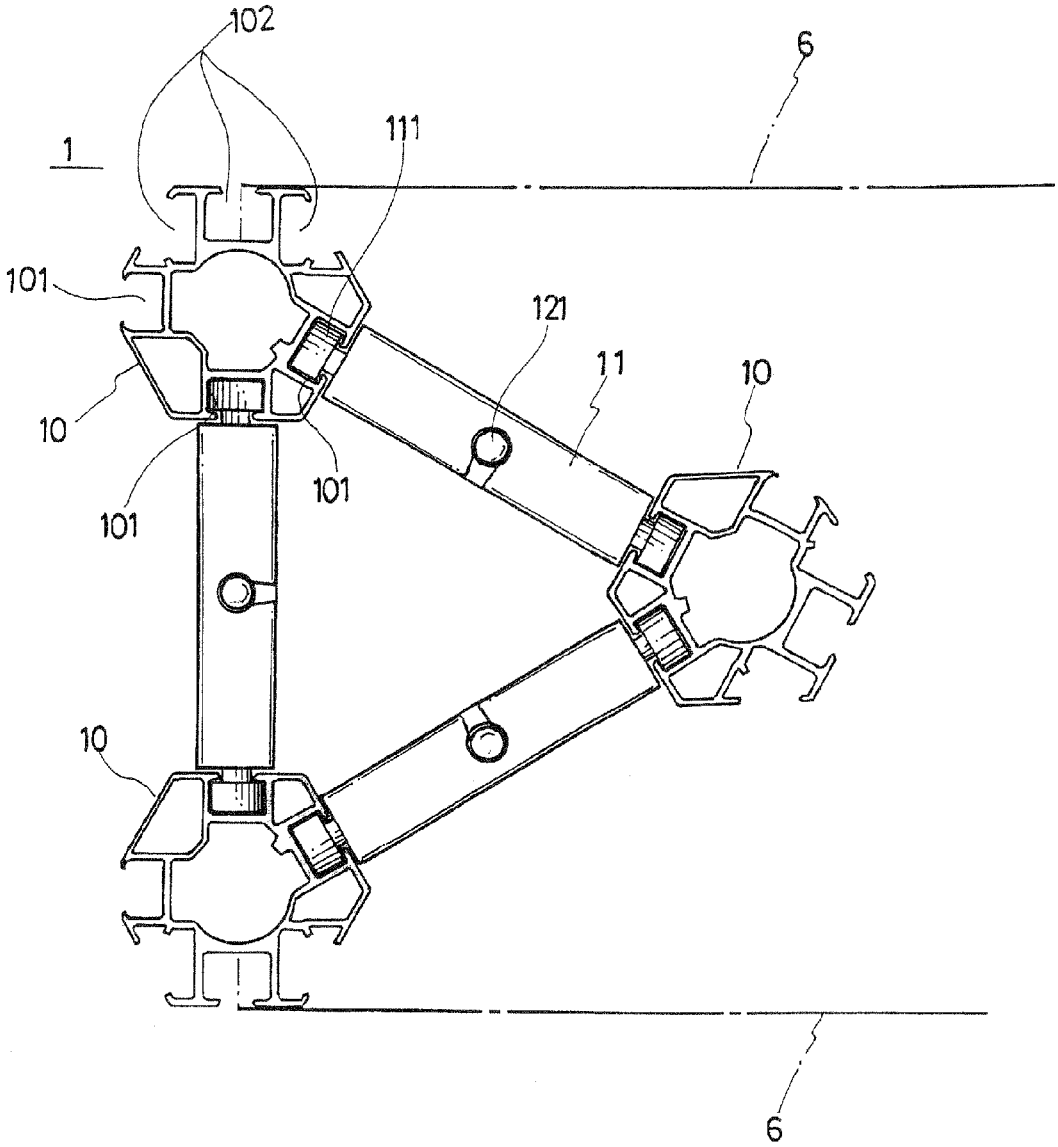
FIG. 4 is a top-view diagram showing a rail member of the rack assembly of FIG. 1.

As described, the rail member 1's triangular prism not only provides enhanced robustness and but also allows more than one curtain 6, as shown in FIG. 4, to be stretched by the rack assembly.

Alternatively, support beams 3 could be configured between two rail members 1 for enhanced stability. Additionally, a cable winder 4 and pulley sets 5 could be configured on the rail members 1 to lilt or lower the stretching members 2 along the column elements 10. If a curtain 6 is connected to the stretching members 2, by this way, the curtain 6 could be expanded or collapsed. By the elastic hook elements 22's flexibility and buffering, an expanded curtain 6 could sustain a stronger of impact from winds or other external sources.

Please also note that each fastening element 12 contains a single bolt 121 threading through the notch 112 and the through hole 113 of two vertically adjacent connection elements 11, and screwing to a nut 122. The connection elements 11 are reliably joined vertically together. However, the connection elements 11 are still capable of laterally rotation. Therefore, connection elements 11 could be applied to curved column elements 10 so that they jointly could expand and stretch a curtain 6 in a curved display manner.

Figure 6:
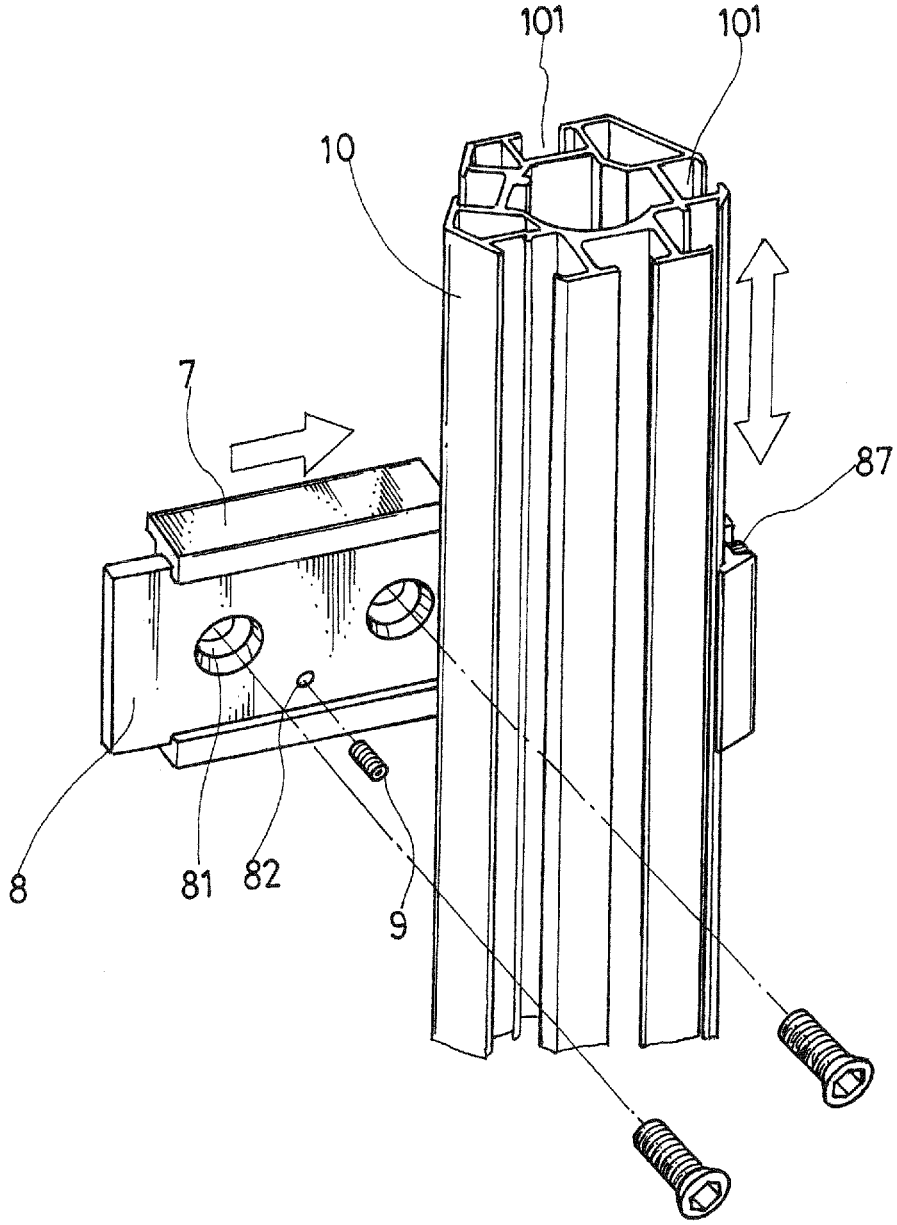
FIG. 6 is a perspective diagram showing a rail member of the rack assembly of FIG. 1 joined to a positioning piece and a sliding piece.
Figure 7:
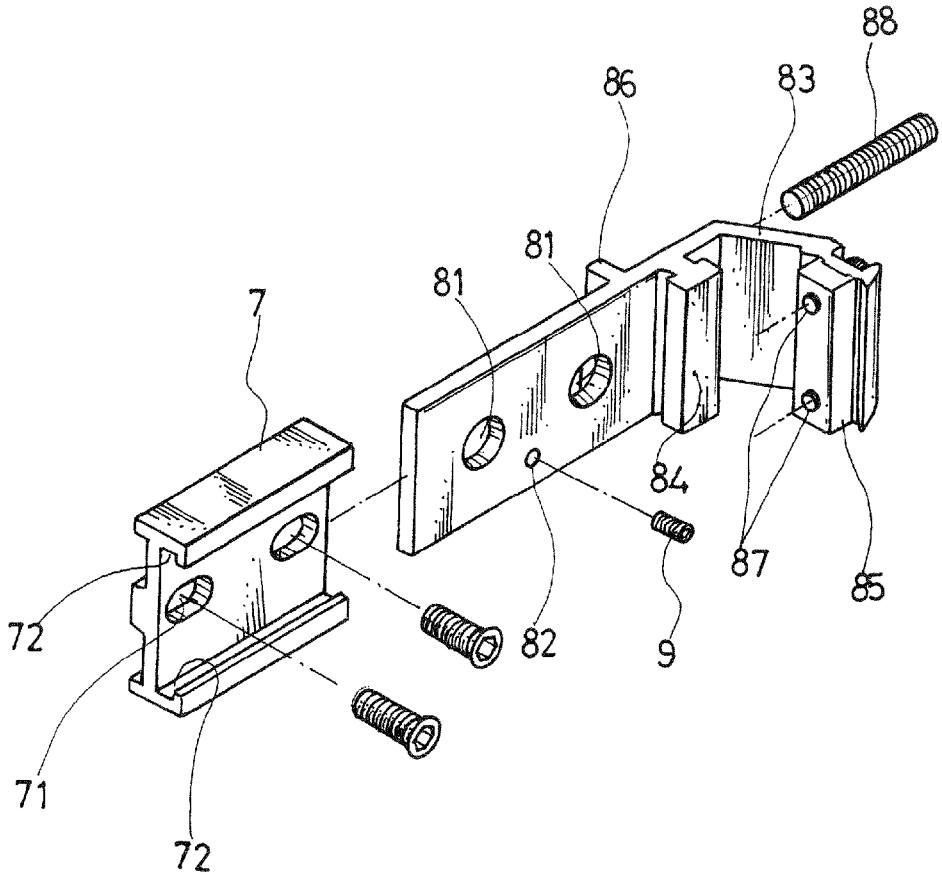
FIG. 7 is a perspective diagram showing the positioning and sliding pieces of FIG. 6.

As further shown in FIGS. 6 and 7, each rail member 1 could further contain at least one positioning piece 7 and one corresponding sliding piece 8. Each positioning piece 7 has at least two through holes 71 and two rails 72 along a top edge and a bottom edge of the positioning piece 7, respectively. The sliding piece 8 then could be slid between the top and bottom rails 72 of the positioning piece 7. The sliding piece 8 has at least two through holes 81 and a smaller through hole 82, and is extended to form a stop block 86 and a locking section 83. An adjustment bolt 88 is threaded through the stop block 86. The extension section 83 could be bended in accordance with the circumferential shape of a column element 10. On an inner surface of the sliding piece 8 and the extension section 83, respectively, a first track 84 and a second track 85 are provided for embedding into two connection grooves 101 of the column element 10. A number of bolts 87 are provided to drive through the extension section 83 and the second track 85.

In an application scenario where a single column element 10 is used in the rail member 1, a positioning piece 7 is first fixed to an object (e.g., a wall or a support surface) by driving some fastening elements through the through holes 71. The sliding piece 8 is then inserted into the positioning piece 7 so that the sliding piece 8 could slide laterally between the rails 72. When the sliding piece 8 is at a desired location, a bolt 9 is driven through the smaller through hole 82 and the adjustment bolt 88 is adjusted as well so as to tightly press and laterally position the sliding piece 8. In the mean time, the first and second tracks 84 and 85 are embedded into the connection grooves 101 so that the column element 10 could vertically move through the sliding piece 8. When the column element 10 is at a desired location, bolts 87 are applied to lock the column 10 to the sliding piece 8 at the desired location. As such, the rail member 1 is reliably raised by the support of an external object (e.g., a wall or a support surface).

The gist of the present invention is as follows. The rack assembly could be speedily put together by the column elements 10 and connection elements 11 of the rail members 1. The vertically joined connection elements 11 fortify the strength of the rail members 1. The stretching members 2 have their wheels 21 movably embedded in the sliding grooves 102 and the curtain 6 could be expanded and stretched from multiple directions. In contrast to the prior arts where independent columns are used or welding is required to join the parts together, the present invention is prevented from rack deformation, breaking, high assembly cost, and difficult assembly. Additionally, in the prior art, there is a single sliding groove sustaining the impact of the curtain. Therefore, it would produce a large clanking noise or even cause the sliding groove to deform.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A rack assembly for displaying a curtain, comprising:

at least a rail member; and a plurality of stretching members movable configured on said rail member, each stretching member connected to said curtain;

wherein each rail member comprises two or more column elements, each column element having a plurality of connection grooves and sliding grooves, said connection grooves facing different directions, and each stretching member moveably attached to said sliding grooves;

a positioning piece having at least two through positioning holes and two rails along an upper edge and a lower edge of said positioning piece;

a sliding piece slidably inserted between said upper and lower rails of said positioning piece, said sliding piece having an extension section, a first track and a second track being configured on said sliding piece and said extension section, respectively, and said first and second tracks being embedded into two of said plurality of said connection grooves of a respective column element, respectively;

a plurality of connection elements, each connection element having a notch at a top end, a through hole at a bottom end, and connection blocks at lateral ends, said connection elements being vertically stacked and positioned between said two or more column elements which are adjacent by embedding said connection blocks into corresponding connection grooves of said two or more column elements, respectively; and a plurality of fastening elements, each connecting two vertically adjacent connection elements through said notch and said through holes of said connection elements.

2. The rack assembly according to claim 1, wherein said positioning piece is fixed to an object by running additional fastening elements through said positioning holes of said positioning piece.

3. The rack assembly according to claim 1, wherein said sliding piece has at least two through holes.

4. The rack assembly according to claim 1, wherein a plurality of bolts run through said extension section and said second track of said sliding piece.

5. The rack assembly according to claim 1, wherein said extension section of said sliding piece is bended in accordance with the circumferential shape of a respective column element of said two or more column elements which said extension is joined to.

6. The rack assembly according to claim 1, wherein each fastening element contains a bolt, a nut, and a spring; and said bolt is threaded through said spring, said notch of a lower connection element, said through hole of an upper connection element, and is fastened to said nut.

7. The rack assembly according to claim 1, wherein each connection element has a closed ring shape.

* * * * *